US010605554B2

(12) United States Patent
Marin

(10) Patent No.: US 10,605,554 B2
(45) Date of Patent: Mar. 31, 2020

(54) LATERALLY PIVOTING TRIGGER LEVER

(71) Applicant: Rok Marin, Celje (SI)

(72) Inventor: Rok Marin, Celje (SI)

(73) Assignee: Rok Marin (SI)

( * ) Notice: Subject to any disclaimer, the term of this patent is extended or adjusted under 35 U.S.C. 154(b) by 0 days.

(21) Appl. No.: 16/079,183

(22) PCT Filed: Feb. 24, 2017

(86) PCT No.: PCT/SI2017/000004
§ 371 (c)(1),
(2) Date: Aug. 23, 2018

(87) PCT Pub. No.: WO2017/146654
PCT Pub. Date: Aug. 31, 2017

(65) Prior Publication Data

US 2019/0056190 A1 Feb. 21, 2019

Related U.S. Application Data

(60) Provisional application No. 62/299,301, filed on Feb. 24, 2016.

(51) Int. Cl.
*F41A 19/10* (2006.01)

(52) U.S. Cl.
CPC ..... *F41A 19/10* (2013.01)

(58) Field of Classification Search
CPC ..... F41A 19/10
(Continued)

(56) References Cited

U.S. PATENT DOCUMENTS 6,957,644 B2 * 10/2005 Simo ..... F41A 19/10 124/31
7,325,539 B2 * 2/2008 Simo ..... F41A 19/10 124/31

(Continued)

FOREIGN PATENT DOCUMENTS

| | | | |
|---|---|---|---|
| DE | 29703375 | U1 | 4/1997 |
| FR | 2163178 | A5 | 7/1973 |
| IT | PI20110004 | A1 | 7/2012 |

*Primary Examiner* — Samir Abdosh
(74) *Attorney, Agent, or Firm* — The Watson IP Group, PLC; Jovan N. Jovanovic

(57) ABSTRACT

The subject of the invention is an improved trigger and trigger mechanism that compensates for an undesirable movement of the firearm from the aimed direction, when the shooter presses the trigger. The trigger (1) consists of the fixed part (11) of the trigger (1) and the pivotal part (12) of the trigger (1), whereby the fixed part (11) of the trigger (1) is lever mounted to the remaining trigger mechanism (2) or linearly mounted to it. The pivotal part (12) of the trigger (1) is pivotally mounted to the fixed part (11) of the trigger (1) through an axis (13). The axis (13) of the pivotally mounting, around which the pivotal part swings, (12) lies in a plane (P) that is defined by the longitudinal axis (A) of the trajectory of the projectile in the firearm and longitudinal axis of the handle (3) of the firearm, whereby the axis (13) of the pivotally mounting is essentially parallel to the longitudinal axis (A) of the trajectory of the projectile in the firearm or, vis-a-vis the longitudinal axis (A), is at an angle less than 80 degrees in one or the other direction. The pivotal part (12) of the trigger (1) in its neutral position, when no force of the shooter's finger is applied, essentially extends in the plane (P), but when the pressure of the shooter's finger is applied to it, it moves from its neutral position around the axis (13) of the pivotally mounting outside the plane (P) by the angle of divergence (a). The trigger (1) also optionally
(Continued)

includes a spring element (4, 5) that holds the pivotal part (12) in the neutral position when no force of the shooter's finger is applied, irrespective of the position of the firearm, and returns the pivotal part (12) of the trigger (1) to its neutral position when the pressure of the finger on the pivotal part (12) subsides. The trigger (1) also optionally includes limiting means (6) that prevent deviation of the pivotal part (12) of the trigger (1) over the maximum possible angle of divergence (a) of the pivotal part (12) of the trigger (1).

12 Claims, 10 Drawing Sheets

(58) Field of Classification Search
USPC ..... 42/69.01, 42.02, 136
See application file for complete search history.

(56) References Cited

U.S. PATENT DOCUMENTS

| | | | | |
|---|---|---|---|---|
| 8,572,878 | B2 * | 11/2013 | Gentilini | F41A 17/72 42/69.01 |
| 2005/0121013 | A1 * | 6/2005 | Simo | F41A 19/10 124/31 |
| 2013/0104435 | A1 * | 5/2013 | Fuller | F41A 19/10 42/69.01 |
| 2013/0146637 | A1 * | 6/2013 | Lin | B25F 5/00 227/8 |
| 2019/0056190 | A1 * | 2/2019 | Marin | F41A 19/10 |

* cited by examiner

LATERALLY PIVOTING TRIGGER LEVER

This invention falls into the category small arms with projectiles, triggered by pressing the trigger with a finger, for example single-shot, repeating or semi-automatic firearms, shotguns, pistols, revolvers, irrespective of the propelling mechanism, e.g. powder or compressed air/gas or crossbows. More specifically, the invention relates to an improved trigger mechanism, which includes a trigger.

Trigger mechanisms in the current state of the art are used by the shooter, by pressing the trigger which forms part of the trigger mechanism, to activate the projectile, so that the latter is released in the pointed direction. In firearms using powder, the shooter presses the trigger, which ignites the explosive filling in the ammunition through the trigger mechanism and activation of the firing pin, causing the projectile to be released through the barrel of the firearm in the pointed direction. According to the current state of the art, the trigger, when pressed, moves with respect to the remaining trigger mechanism, either as a lever, which means that it is with one point pivotally mounted into the trigger mechanism, or linearly, meaning that the mechanism moves in a straight line when pressed, e.g. the Colt 1911. When the trigger is mounted in the trigger mechanism as a lever, i.e. lever mounted trigger, and when the trigger is mounted in the trigger mechanism linearly, i.e. linearly mounted trigger, the trigger moves preferably in the plane, which is the same or parallel to the plane P, defined by the longitudinal axis A of the trajectory of the projectile in the firearm and the longitudinal axis of the handle of the firearm, which is located so close to the trigger that the shooter holds the handle and reaches and actuates the trigger with the finger of the same hand. In firearms with a barrel, through which the projectile is released, the longitudinal axis A of the trajectory corresponds to the longitudinal axis of the barrel of the firearm. In crossbows, the longitudinal axis A of the trajectory in the firearm corresponds to the longitudinal axis of the arrow placed in the crossbow or chamber along which the arrow travels when ejected.

When shooting with such a firearm, for example shooting at a target, one of the key requirements is to facilitate solid and simple trigger control and shooting with the highest possible precision, ensuring that the pressure a finger places on the trigger, which must be strong enough to trigger the firearm, does not cause a change in direction in which the firearm is aimed. Due to the anatomic characteristics of a human hand or fingers, when a shooter uses their finger to press the trigger, a force is released in the firearm which may cause undesirable movement of the firearm away from the aimed direction, which leads to poorer shooting accuracy. By pressing the trigger, the shooter merely wishes to actuate the trigger without changing the direction of the barrel, which would be possible if the direction of the finger's force through the trigger applied to the firearm was completely aligned with longitudinal axis A of the trajectory in the firearm. A human hand contains bones and joints, which essentially enable the rotation of bones around joints, and not linear movement. Because of this movement and as a result of the existing construction of the firearm, the direction of the finger's force applied to the trigger cannot be linear and fully aligned with the longitudinal axis A, which at the time of pressing the trigger causes the undesirable movement of the firearm away from the aimed direction.

With this invention, the trigger and the trigger mechanism try to reduce or eliminate the above mentioned drawback of the existing trigger mechanisms.

In order to eliminate this problem, patent application no. U.S. Ser. No. 13/317,823 proposes a trigger mechanism with a trigger lever that is formed as a cylindrical shaft that is attached to the trigger mechanism through the upper and/or lower part. A sleeve which freely rotates around the shaft is fitted to the cylindrical shaft by adequate means. The proposed trigger mechanism assembly compensates for or transforms the automatic rotation of the finger, mostly, into linear movement, but does not resolve sufficiently the automatic lateral movement of the finger.

The above-mentioned drawbacks are eliminated with a trigger and trigger mechanism according to the invention that is described below and illustrated in the figures as follows:

FIG. 1 shows the pistol in the current state of the art with the linearly mounted trigger FIG. 2 shows the trigger with the trigger mechanism in the current state of the art, which is lever mounted into the trigger mechanism FIG. 3 shows the lever mounted trigger with the trigger mechanism according to the invention FIG. 4 shows the trigger according to the invention, where the fixed part of the trigger is lever mounted to the trigger mechanism (detail)

FIG. 5 shows the trigger according to the invention, where the fixed part of the trigger is connected to the trigger mechanism linearly wherein the mounting of the pivotal part of the trigger is in the part closest to the axis A FIG. 6 shows the trigger according to the invention, where the fixed part of the trigger is connected to the trigger mechanism linearly (B-B cross section as in FIG. 5)

FIG. 7 shows the trigger according to the invention, where the fixed part of the trigger is connected to the trigger mechanism linearly in the deviated L and R position and in the neutral position FIG. 8 shows the trigger according to the invention, where the fixed part of the trigger is connected to the trigger mechanism linearly in the deviated position and in the neutral position (A-A cross section as in FIG. 5)

Figure 1:
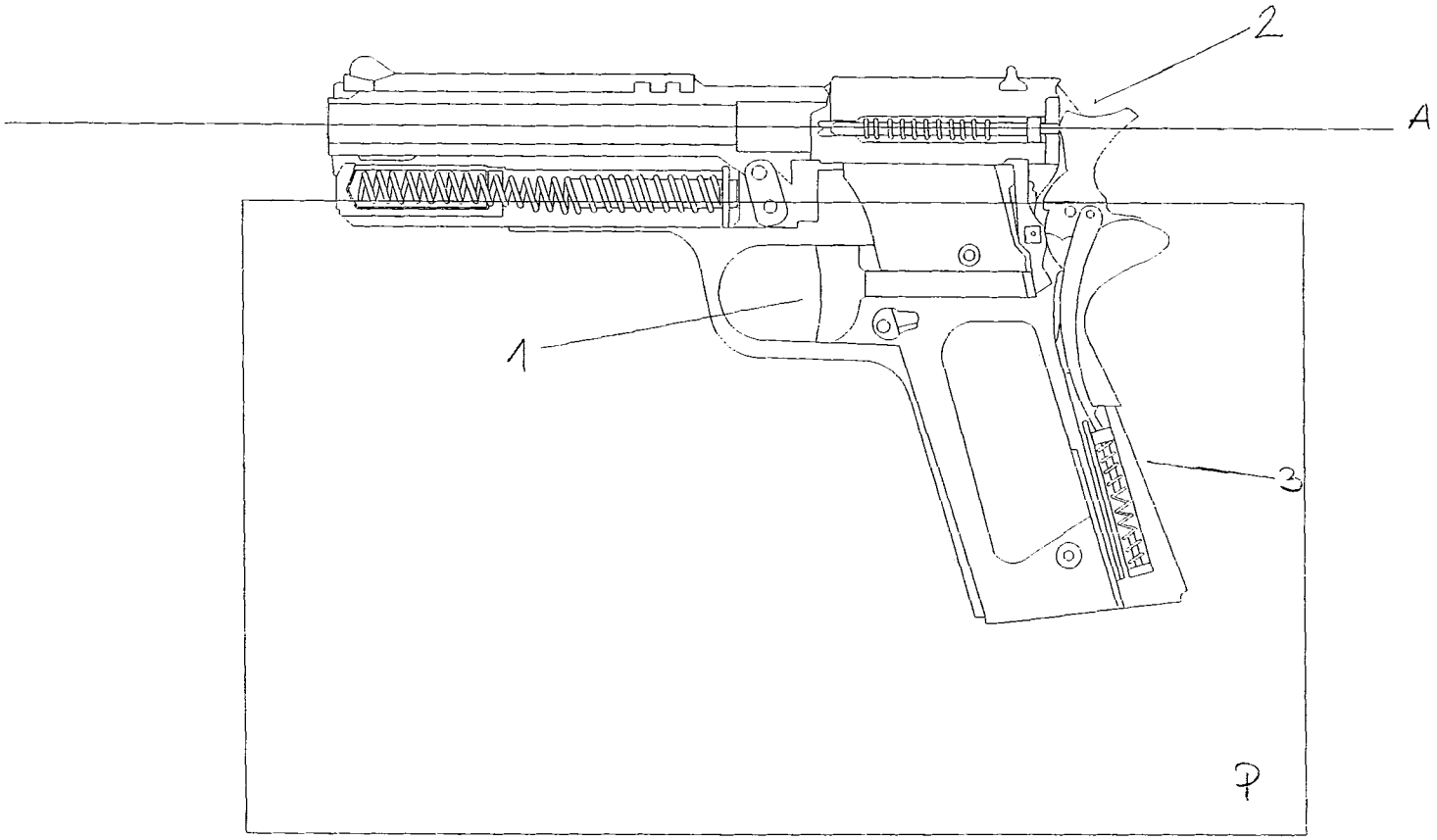
Figure 2:
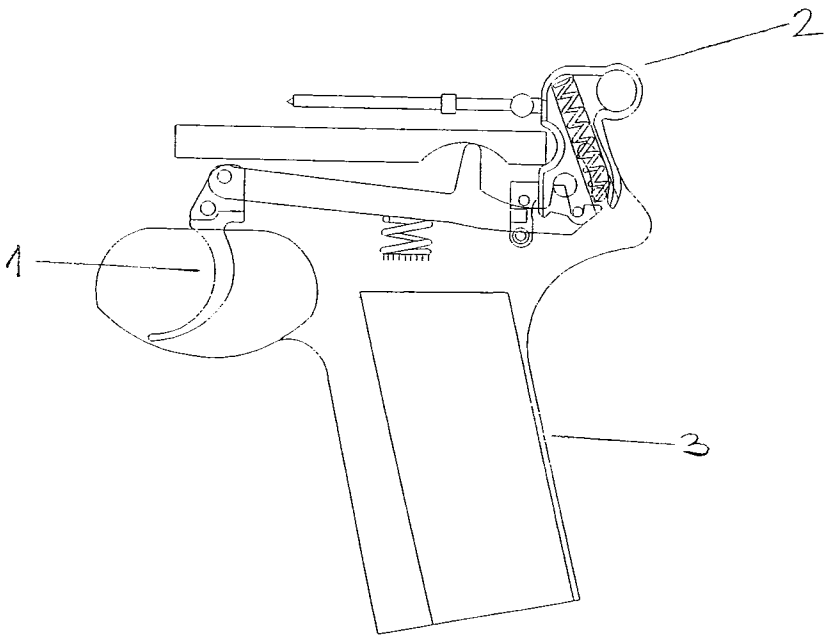
Figure 3:
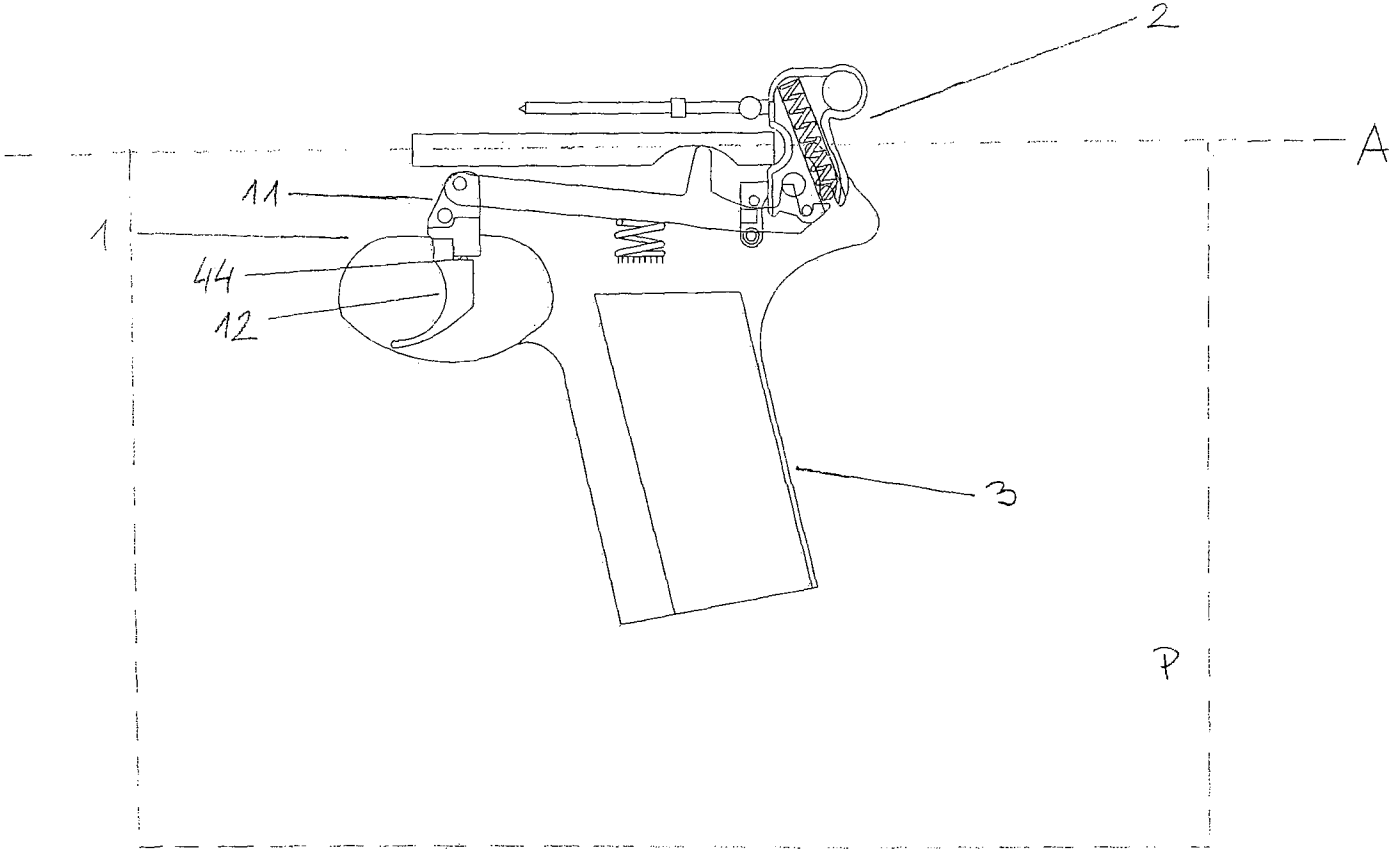

The trigger 1 according to the invention, shown in FIG. 3 through 9, differs from the triggers according to the current state of the art, shown in FIGS. 1 and 2, in that it consists of a fixed part 11 of the trigger 1 and a pivotal part 12 of the trigger 1. The fixed part 11 of the trigger 1 is connected to the remaining trigger mechanism 2 either with a lever or linearly in ways that are standard and recognised in the current state of the art. The detailed construction of this fixing, which is not a novelty, depends on the type of the firearm. The pivotal part 12 of the trigger 1 is pivotally mountable to the fixed part 11 of the trigger 1, whereby the axis 13 of the pivotally mounting, around which the pivotal part 12 can swing, lies in plane P, which is defined with the longitudinal axis A of the trajectory of the projectile in the firearm and the longitudinal axis of the handle 3 of the firearm, which is positioned so close to the trigger 1 that it enables the shooter to hold the handle 3 with his arm and also reaches the pivotal part 12 with the finger of the same hand. Axis 13 of the pivotally mounting with respect to the longitudinal axis A is at an angle in one or the other direction, which is less than 80 degrees, preferably less than 45 degrees, most preferably between 0 to 5 degrees. In the most preferred embodiment the axis 13 of pivotally mounting is parallel to the longitudinal axis A of the trajectory of the projectile in the firearm.

If a version of the firearm has multiple barrels, e.g. in two barrel shotguns, the longitudinal axis A within the meaning of this invention is parallel to the individual axes of the trajectory in each individual barrel of the firearm and placed as symmetrically as possible to the central position vis-à-vis the mentioned individual axes of the trajectories.

The pivotal part 12 of the trigger 1 in its neutral position, when no pressure from the shooter's finger is applied, essentially extends in the plane P. When the shooter presses on the pivotal part 12 of the trigger 1, part of the force is transmitted through the pivotally mounting to the fixed part 11 of the trigger 1, which actuates the triggering of the firearm through the entire trigger mechanism 2. However, due to the construction of the trigger 1 according to this invention, part of the force of the finger, which would otherwise contribute to the movement of the firearm barrel away from the aimed direction, only causes a swing movement of the pivotal part 12 of the trigger 1 around the axis 13 of the pivotally mounting outside the plane P by the angle of divergence $\alpha$.

The maximum possible angle of divergence $\alpha$ of the pivotal part 12 from its neutral position into one or the other direction is less than 90 degrees, preferably is up to 45 degrees, more preferably is up to 20 degrees.

Figure 8:
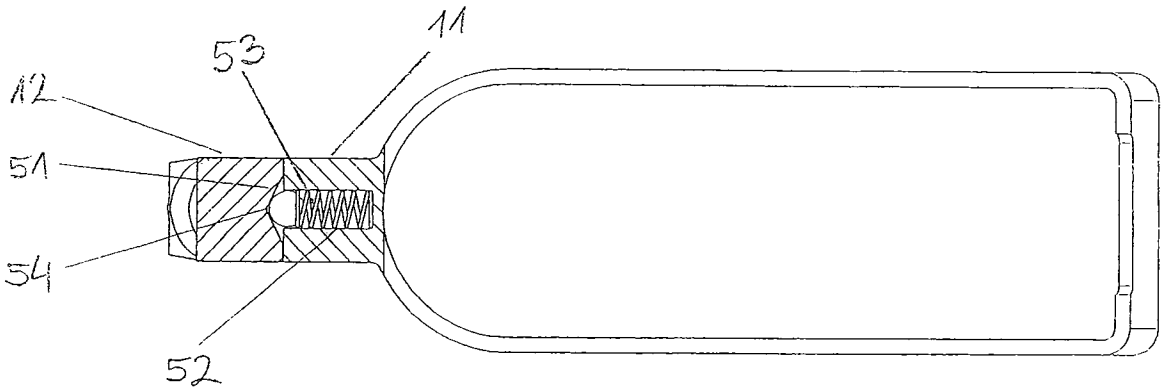
Figure 9:
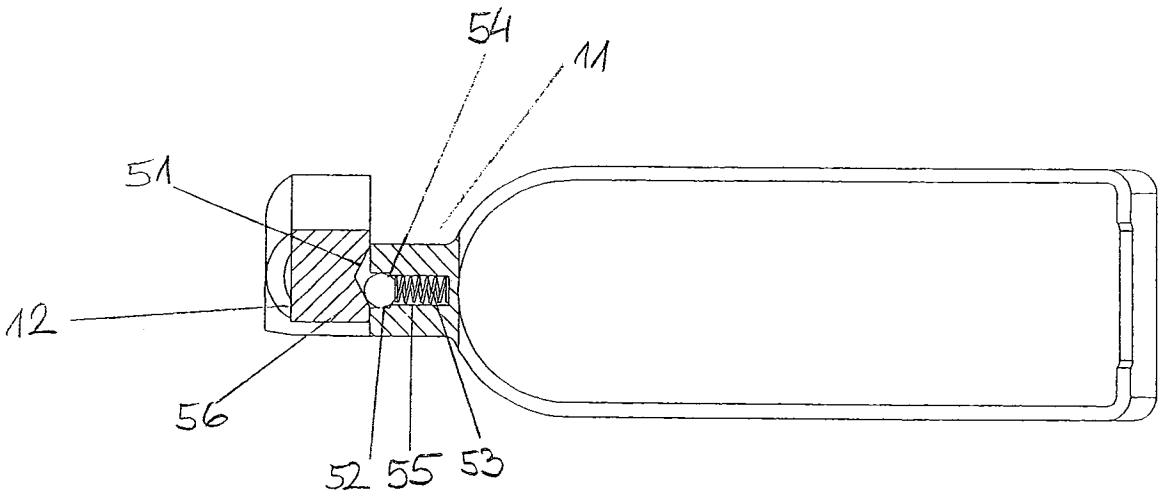
FIG. 9 shows the trigger according to the invention, where the fixed part of the trigger is connected to the trigger mechanism linearly with the integration of the limiting means and the spring element (A-A cross section as in FIG. 5)
Figure 10:
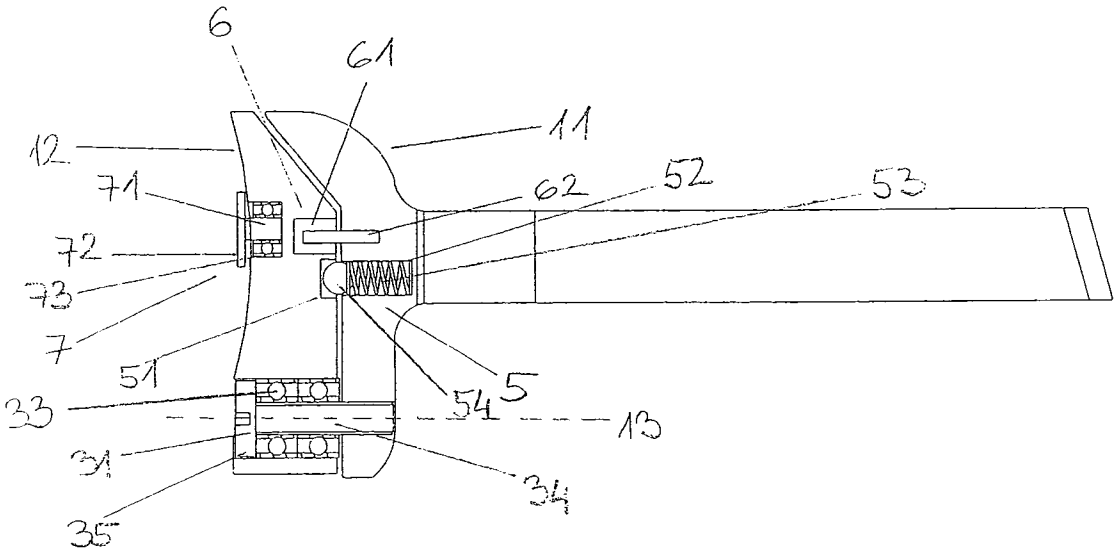
FIG. 10 shows the trigger according to the invention, where the fixed part of the trigger is connected to the trigger mechanism linearly wherein the mounting of the pivotal part of the trigger is furthest from the axis A and with a rotating plate on the pivotal part.

The pivotally mounting area of the pivotal part 12 of the trigger 1 on the fixed part 11 of the trigger 1 can be located on the pivotal part 12, either in the area that is closest to the longitudinal axis A of the trajectory in the firearm, which is a preferred embodiment, and is shown in FIG. 3 through 9, or in the area that is furthest from the longitudinal axis A and is shown in FIG. 10.

When the shooter presses the trigger, the undesired component of the force that is applied perpendicularly to the plane P is eliminated or reduced, given that the finger, due to the swing movement of the pivotal part 12 of the trigger 1, can move freely also in the directions that are essentially perpendicular to the plane P.

Optionally between the pivotal part 12 of the trigger 1 and the remaining firearm, preferably the fixed part 11 of the trigger 1, the spring element 4, 5 is positioned, which works in such a way that it holds the pivotal part 12 in a neutral position, when no pressure of the finger is applied to it, irrespective of the position of the firearm. In addition, the spring element 4, 5 returns the pivotal part 12 of the trigger 1 to the neutral position, when the pressure of the finger is no longer applied to the pivotal part 12, e.g. after triggering the firearm. It is desirable the force of the spring element 4, 5 to be as weak as possible, so that it does not represent a significant counter force to the finger, when the latter is pressing the trigger 1, but strong enough to return the pivotal part 12 of the trigger 1 to the neutral position, when the pressure of the finger subsides, even if the firearm is tilted. This enables the shooter to always find the pivotal part 12 of the trigger 1 with their finger in the same position relative to the position of the firearm.

Figure 4:
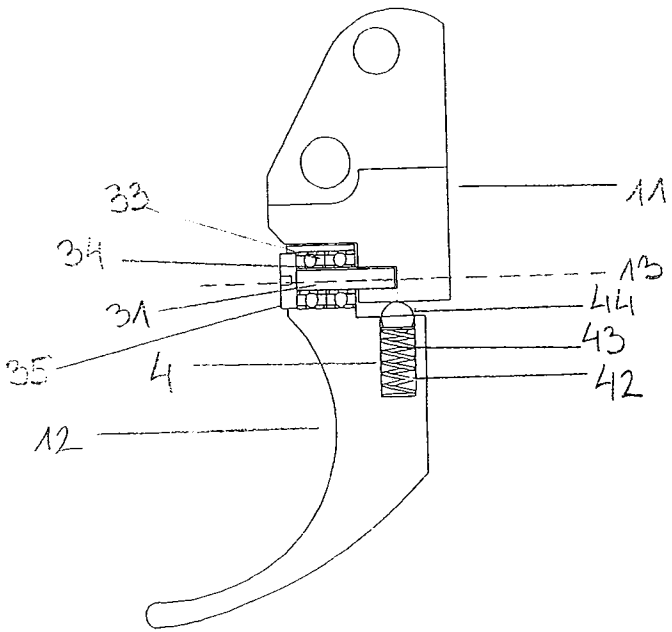

In one embodiment shown in FIG. 4, when the fixed part 11 of the trigger 1 is connected to the remaining trigger mechanism 2 with a lever, the spring element 4 consists of a chamber 42, drilled into the pivotal part 12 of the trigger 1, wherein a spiraling compression spring 43 with a ball 44 is located. The ball 44 partly protrudes out of the chamber 42. The spring 43 is placed in the chamber 42 behind the ball 44, thus being able to push the ball 44 from the chamber. The internal diameter of the chamber 42 is at least equal to the diameter of the ball 44.

In the second of multiple embodiments, e.g. when the fixed part 11 of the trigger 1 is connected to the remaining trigger mechanism 2 linearly and is shown in FIGS. 5, 6, 8 through 10, the spring element 5 consists of a groove 51 in the form of the letters V, U or another concave form, grooved in the pivotal part 12 on the side that is directed toward the fixed part 11, and a chamber 52 in the fixed part 11, which is implemented opposite the described groove 51 and in which a spiral compression spring 53 with a ball 54 is located. The ball 54 partly protrudes out of the chamber 52. The spring 53 is placed in the chamber 52 behind the ball 54 thus being able to push the ball 54 from the chamber 52. In the neutral position of the pivotal part 12 the ball 54 rests in the groove 51 in its deepest possible resting position. When the pivotal part 12 moves from its neutral position, the inner surface of the groove 51 pushes the ball 54 deeper into the chamber 52, to which the opposite force of spring 53 provides resistance. The internal diameter of the chamber 52 is at least equal to the diameter of the ball 54.

The dimension and the form of the groove 51 define the force that will be applied in the direction towards the neutral position to the pivotal part 12 by the spring element 53 at a certain divergence from its neutral position into one or other direction.

Figure 5:
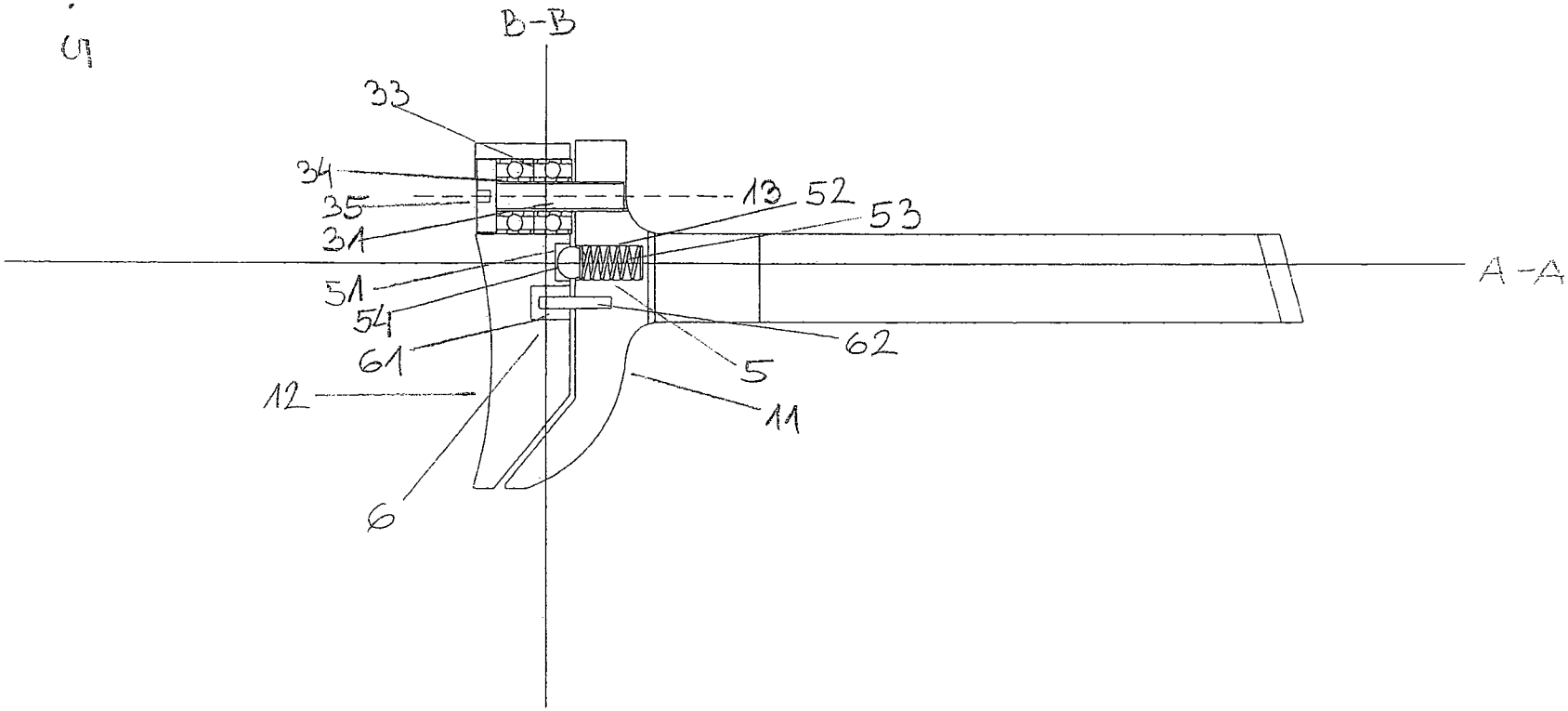
Figure 6:
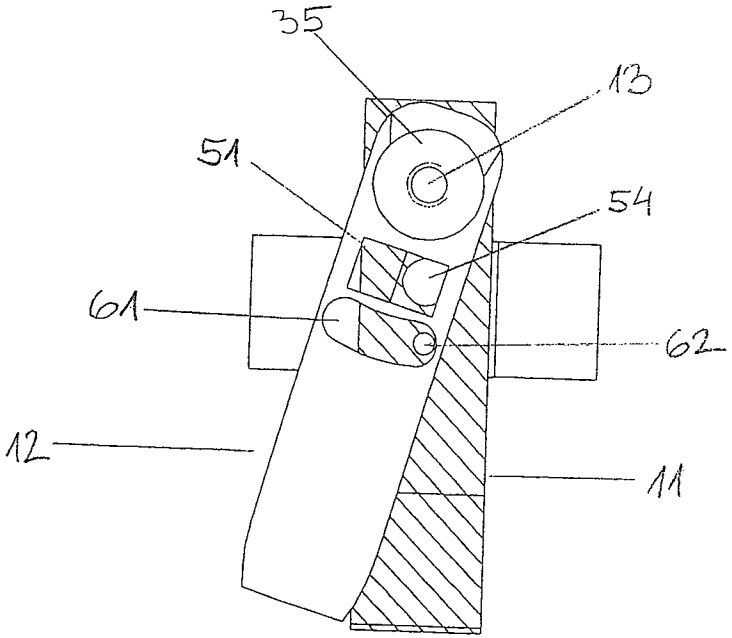
Figure 7:
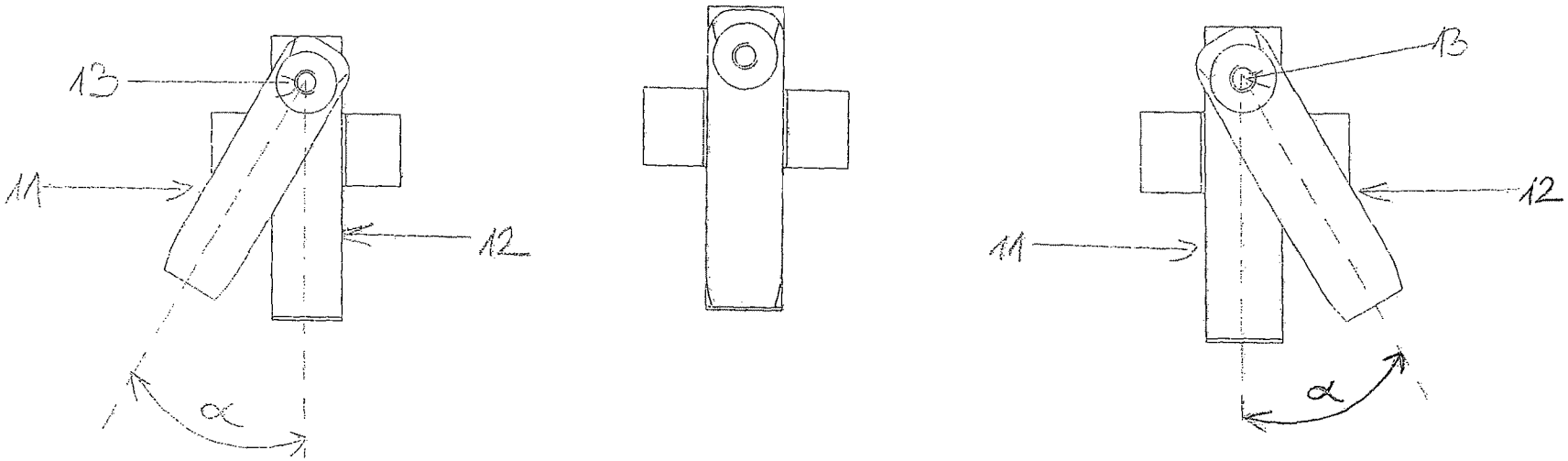

Optionally between the pivotal part 12 of the trigger 1 and the remaining firearm, preferably the fixed part 11 of the trigger 1, limiting means 6 are provided in order to prevent deviation of the pivotal part 12 of the trigger 1 over the maximum possible angle of divergence $\alpha$ of the pivotal part 12. It is desirable that limiting means 6 have no impact on the movement of the pivotal part 12 of the trigger 1 within the defined swing angle of divergence $\alpha$, or their impact is limited to the lowest extent possible. In one of the possible embodiments, limiting means 6 is formed as a channel 61 configured on the pivotal part 12 of the trigger 1 and a pin 62 configured on the fixed part 11 of the trigger 1, as shown in FIGS. 5, 6 and 10. During the swinging of the pivotal part 12 up to the largest possible angle of divergence $\alpha$, the pin 62 moves freely within the channel 61. When the pin 62 reaches the end of the channel 61, further swinging is prevented. The length of the channel 61 defines the largest possible angle of divergence $\alpha$ of the pivotal part 12. The opposite version is also possible the channel 61 is configured on the fixed part 11 and the pin 61 is configured on the pivotal part 12. Versions with multiple channels and pins are also possible.

In FIG. 8 the ball 54 is located in the middle of the groove 51 which is configured on the pivotal part 12 of the trigger 1. If the pivotal part 12 of the trigger 1 is deviated by an angle of divergence $\alpha$ greater than 60 degrees from its vertical position, the ball 54 will fall out of the chamber 52. Limiting means are used to prevent the pivotal part 12 of the trigger 1 from deviating by greater angles of diversion a. FIG. 6 shows the manner in which the pivotal part 12 of the trigger 1 returns to the neutral position. The ball 54 is located in the left side of the groove 51 (seen from the direction of triggering of the firearm). Under the ball 54 the channel 61 is seen, within which the pin 62 moves and thus prevents the ball 54 from falling out of the groove 51, as it limits the deviation of the pivotal part 12 of the trigger 1 over the largest possible angle of divergence $\alpha$. The force of the finger pushes the ball 54 into the chamber 52 in the fixed part 11 of the trigger 1 and thus contracts (squeezes) the spring 53. When the force subsides, the spring 53 in the chamber 52 pushes out the ball 54 and forces the pivotal part 12 of the trigger 1 back to its neutral position.

In one of the possible embodiments, the pivotally mounting of the pivotal part 12 to the fixed part 11 of the trigger 1 is configured with a screw 31 and a bearing 33, whereby the longitudinal axis of the screw 31 is simultaneously also the axis 13 of the pivotally mounting. In this embodiment which is shown in FIGS. 4, 5 and 10, a hole 34 is made through the fixed part 11 and the pivotal part 12 of the trigger 1, through which the screw 31 with a nut 35 is placed, whereby the nut 35 can be integrated either to the fixed part 11 or the pivotal part 12 of the trigger 1. A bearing 33 is placed between the fixed part 11 and the pivotal part 12 of the trigger 1. This reduces friction between both parts, so that the pivotal part 12 can move freely during its swinging motion.

In one of the embodiments, limiting means 6 and the spring element 5 can be integrated as shown in FIG. 9. The spring element 5 may function simultaneously as the limiting means 6 when it is comprised of the groove 51 and the chamber 52 with the ball 54 and the spring 53, as described above. In this case a part 55 of the chamber under the ball 54 has a narrower diameter compared to the ball 54, which prevents the ball 54 from being pushed entirely into the chamber 52, resulting in part of the ball 54 with the protrusion 56 always protruding out of the chamber 52. The spacing between the pivotal part 12 and the fixed part 11 in the area around the extreme left and right point of the groove 51 has to be smaller than the minimum protrusion 56 of the ball out of the chamber 52. In this way the pivotal part 12 cannot exceed the highest possible angle of divergence α, as the groove 51 with the extreme left or right point rests on the minimum protrusion 56 of the ball 54 and thus prevents further divergence of the pivotal part 12.

FIG. 10 shows an example when the area of the pivotally mounting of the pivotal part 12 of the trigger 1 on the fixed part 11 of the trigger on the pivotal part 12 is located in an area that is furthest from the longitudinal axis A. In this embodiment, an additional rotating plate 7 is built-into the pivotal part 12 of the trigger 1. The rotating plate 7 comprises a chamber 71, which is preferably configured in the upper part of the pivotal part 12 of the trigger 1 above the spring element 5, into which a rotating plug 72 is inserted, rotation of which is enabled by bearings 73. A rotating plate 7 additionally reduces lateral force caused by the shooter when pressing the trigger 1. If the shooter's finger rests on the rotating plate 7 or the rotating plug 72, the pivotal part 12 of the trigger 1 may bend left or right at even smaller lateral force.

The invention claimed is:

1. A trigger which is part of a trigger mechanism of a firearm with projectiles, whereby the firearm has a handle that is located so close to the trigger that a shooter holds the handle in their hand and with a finger of the same hand is able to reach the trigger, which is triggered by pressing of their finger, whereby the trigger is lever mounted or linearly mounted to the trigger mechanism, comprising:

the trigger comprises a fixed part of the trigger and a pivotal part of the trigger, whereby the fixed part of the trigger is either lever mounted or linearly mounted to the remaining trigger mechanism, whereby the pivotal part of the trigger is pivotally mounted to the fixed part of the trigger such that the pivoting part swings about an axis that lies in a plane (P) defined by a longitudinal axis (A) of a trajectory of a projectile in the firearm and a longitudinal axis of the handle (3), whereby the axis is generally parallel to the longitudinal axis (A) of the trajectory of the projectile in the firearm, whereby the pivotal part of the trigger in a neutral position thereof, when no force of the shooter's finger is applied to it, essentially extends in the plane (P), and whereby the pivotal part of the trigger, when the force of the shooter's finger is applied to it, swings from the neutral position of the pivotal part around the axis of the pivotally mounting outside the plane (P) by an angle of divergence (α).

2. The trigger according to claim 1, wherein the largest possible angle of divergence α of the pivotal part from the neutral position of the pivotal part into one or the other direction up to 20 degrees.

3. The trigger according to claim 1, the pivotally mounting area of the pivotal part of the trigger on the fixed part of the trigger on the pivotal part is located in an area that is closest to the longitudinal axis (A) of the trajectory of the projectile in the firearm.

4. The trigger according to claim 1, wherein the pivotally mounting area of the pivotal part of the trigger on the fixed part of the trigger on the pivotal part is located in an area that is furthest from the longitudinal axis (A) of the trajectory of the projectile in the firearm.

5. The trigger according to claim 1, wherein the pivotally mounting of the pivotal part to the fixed part of the trigger is configured with a screw and a bearing, whereby a longitudinal axis of the screw is simultaneously also the axis of the pivotally mounting and a hole is made through the fixed part and the pivotal part of the trigger, through which the screw with a nut is placed, that is integrated either in the fixed part or the pivotal part of the trigger, and the bearing is placed between the fixed and the pivotal part of the trigger, which reduces friction between both parts, so that the pivotal part is able to move freely during a swinging motion.

6. The trigger according to claim 1, further comprising a spring element that holds the pivotal part in the neutral position, when no force of the shooter's finger is applied, irrespective of the position of the firearm, and returns the pivotal part of the trigger to the neutral position when the pressure of the finger on the pivotal part subsides.

7. The trigger according to claim 6, wherein the spring element comprises a chamber drilled in the pivotal part of the trigger, where a spiral compression spring with a ball is located whereby the ball partly protrudes out of the chamber and the spring in the chamber is positioned behind the ball.

8. The trigger according to claim 6, wherein the spring element comprises a groove in the form of the letters V, U or another concave form, grooved in the pivotal part on a side facing toward the fixed part, and a chamber in the fixed part implemented opposite the described groove and in which a spiral compression spring with a ball is located, whereby the ball partly protrudes out of the chamber and the spring in the chamber is placed behind the ball, whereby the dimension and the form of the groove define the force that will be applied in the direction towards the neutral position to the pivotal part by the spring element at a certain divergence from a neutral position of the spring element into one or other direction.

9. The trigger according to claim 1, further comprising a limiting means that prevents the deviation of the pivotal part of the trigger over the maximum possible of the angle of divergence (α) of the pivotal part.

10. The trigger according to claim 9, wherein the limiting means is formed as a channel configured on the pivotal part of the trigger and a pin configured on the fixed part of the trigger or vice-versa, whereby the pin during the swinging of the pivotal part up to the largest possible angle of divergence ($\alpha$) moves freely within the channel and the largest possible angle of divergence ($\alpha$) of the pivotal part is defined by the length of the channel.

11. The trigger according to claim 8, wherein the spring element, when it comprises the groove and the chamber with the ball and the spring, is simultaneously the limiting means, whereby a part of the chamber under the ball has a narrower diameter than the diameter of the ball, to prevent the ball from being pushed entirely into the chamber, so that part of the ball with the protrusion always protrudes out of the chamber, so that the extreme part of the groove rests on the minimum protrusion of the ball and thus prevents further divergence of the pivotal part.

12. The trigger according to claim 1, wherein when the pivotally mounting area of the pivotal part of the trigger on the fixed part of the trigger on the pivotal part is located in the area that is furthest from the longitudinal axis (A), an additional rotating plate, which includes a chamber, to which a rotating plug (72) is inserted, and the rotating of which is enabled with bearings, is integrated in the pivotal part of the trigger.

* * * * *